US008516868B2

(12) United States Patent
Rhee et al.

(10) Patent No.: US 8,516,868 B2
(45) Date of Patent: Aug. 27, 2013

(54) DIES FOR SHEAR DRAWING

(75) Inventors: Ki-Ho Rhee, Pohang (KR); Il-Heon Son, Pohang (KR); Joong-Ki Hwang, Pohang (KR); Duk-Lak Lee, Pohang (KR)

(73) Assignee: Posco, Pohang (KR)

( * ) Notice: Subject to any disclaimer, the term of this patent is extended or adjusted under 35 U.S.C. 154(b) by 162 days.

(21) Appl. No.: 13/141,116

(22) PCT Filed: Dec. 10, 2009

(86) PCT No.: PCT/KR2009/007399

§ 371 (c)(1),
(2), (4) Date: Jun. 21, 2011

(87) PCT Pub. No.: WO2010/074438

PCT Pub. Date: Jul. 1, 2010

(65) Prior Publication Data

US 2011/0247388 A1 Oct. 13, 2011

(30) Foreign Application Priority Data

Dec. 26, 2008 (KR) ..... 10-2008-0134872

(51) Int. Cl.
*B21C 23/00* (2006.01)

(52) U.S. Cl.
USPC ..... 72/253.1; 72/364; 148/538

(58) Field of Classification Search
USPC ..... 72/253.1, 257, 258, 262, 270, 272, 72/282, 289, 342.8, 363, 364, 377; 148/538, 148/550, 557
See application file for complete search history.

(56) References Cited

U.S. PATENT DOCUMENTS 5,400,633 A 3/1995 Segal et al.
5,513,512 A 5/1996 Segal
5,826,456 A * 10/1998 Kawazoe et al. ..... 72/253.1

(Continued)

FOREIGN PATENT DOCUMENTS

JP 2001192772 A 7/2001
JP 2001321825 A 11/2001

(Continued)

OTHER PUBLICATIONS

Alkorta, et al., "On the impossibility of multi-pass equal-channel angular drawing", Scripta Materialia, 2002, pp. 13-18, vol. 47, Elsevier Science Ltd.

(Continued)

*Primary Examiner* — David B Jones
(74) *Attorney, Agent, or Firm* — The Webb Law Firm

(57) ABSTRACT

Provided is a die for shear drawing capable of performing continuous drawing and shear deformation at the same time. The die for shear drawing includes a material processing channel in which a material is sheared and drawn while passing therethrough, wherein the processing channel includes an inlet path positioned at a front end thereof, and an outlet path positioned at a rear end thereof, when viewed from a movement direction of a material. The inlet path and the outlet path are connected to intersect a central axes thereof at a certain angle, and the processing channel includes a cross-section reduction segment allowing an outlet cross-sectional area of the outlet path to be smaller than an inlet cross-sectional area of the inlet path to thereby draw out a material from an exit of the outlet path with the material filled therein.

8 Claims, 6 Drawing Sheets

(56) References Cited

U.S. PATENT DOCUMENTS

| | | | | |
|---|---|---|---|---|
| 5,904,062 | A * | 5/1999 | Semiatin et al. | 72/253.1 |
| 6,399,215 | B1 * | 6/2002 | Zhu et al. | 428/544 |
| 6,571,593 | B1 * | 6/2003 | Chung et al. | 72/262 |
| 6,723,187 | B2 * | 4/2004 | Segal et al. | 148/538 |
| 6,895,795 | B1 | 5/2005 | Chauidhury et al. | |
| 7,140,222 | B2 * | 11/2006 | Park et al. | 72/262 |
| 7,845,203 | B2 * | 12/2010 | Han et al. | 72/253.1 |
| 7,846,378 | B2 * | 12/2010 | Cooley et al. | 264/604 |
| 2005/0016243 | A1 | 1/2005 | Segal | |
| 2011/0247388 | A1 * | 10/2011 | Rhee et al. | 72/380 |

FOREIGN PATENT DOCUMENTS

| | | | |
|---|---|---|---|
| JP | 2002248517 | A | 9/2002 |
| JP | 2005000991 | A | 1/2005 |
| KR | 20020093403 | A | 12/2002 |

OTHER PUBLICATIONS

Chakkingal, Uday et al., "Microstructure Development During Equal Channel Angular Drawing of Al at Room Temperature", Scripta Materialia, 1998, pp. 677-684, vol. 39, No. 6, Acta Metallurgica Inc.

Park, Jong U et al., "Technologies of Manufacturing High-trength Nano-Bulk Materials by Severe Plastic Deformation", Trends in Metals & Materials Engineering, 2003, pp. 10-29, vol. 16.

* cited by examiner

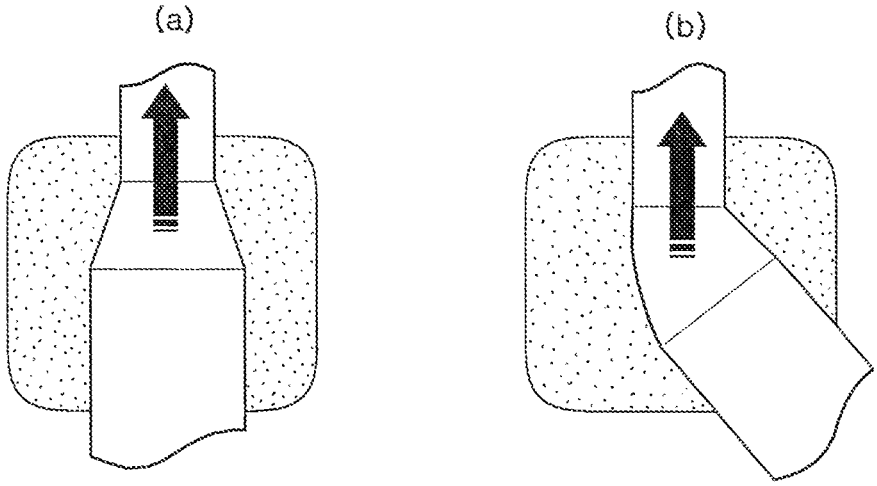
Prior Art FIG. 1
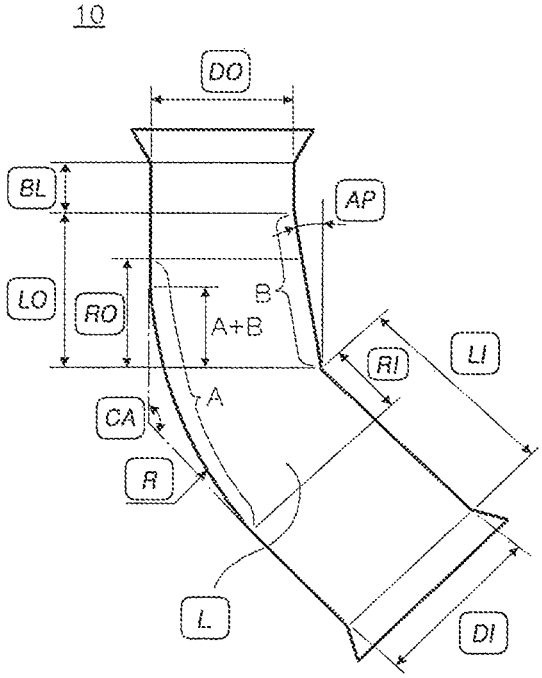
FIG. 2

(a)
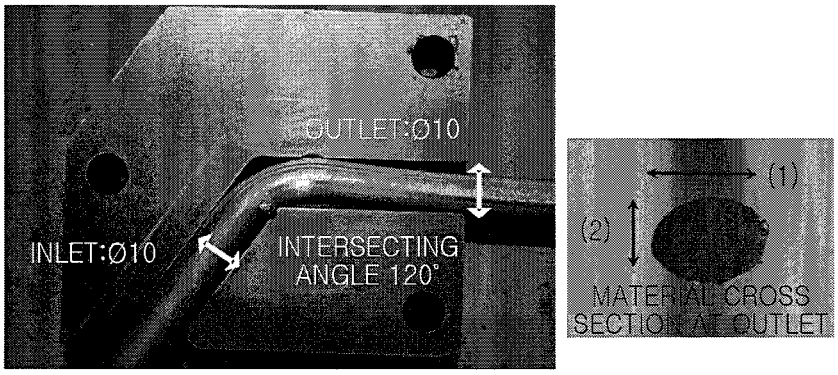
(b)
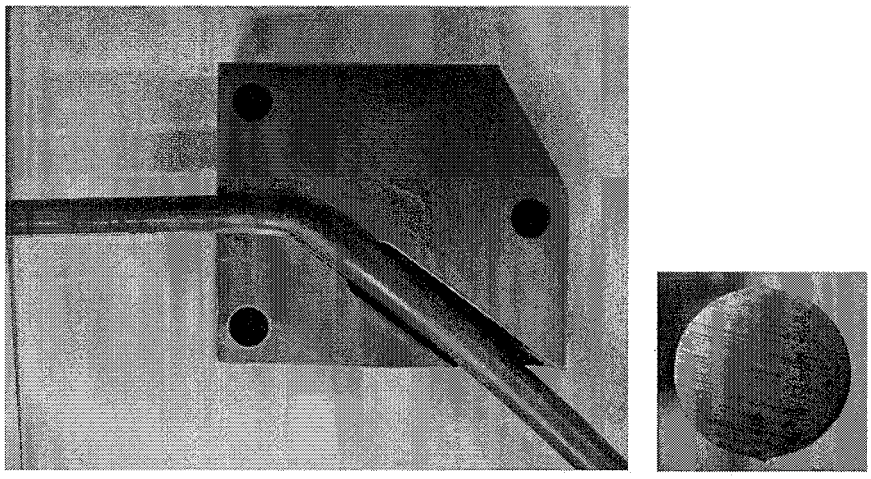
FIG. 5

(a)
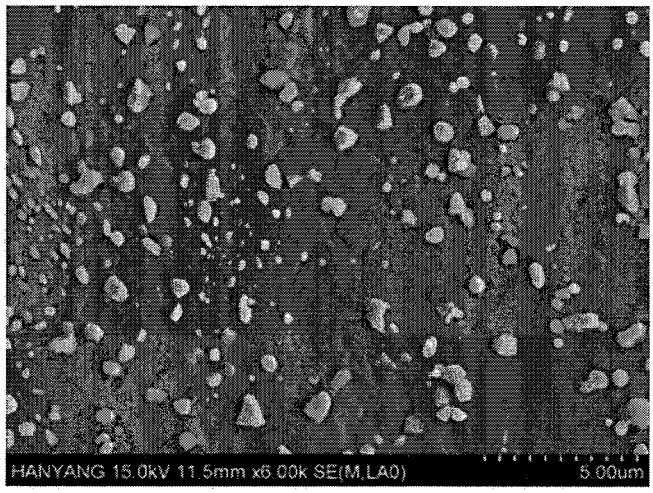
(b)
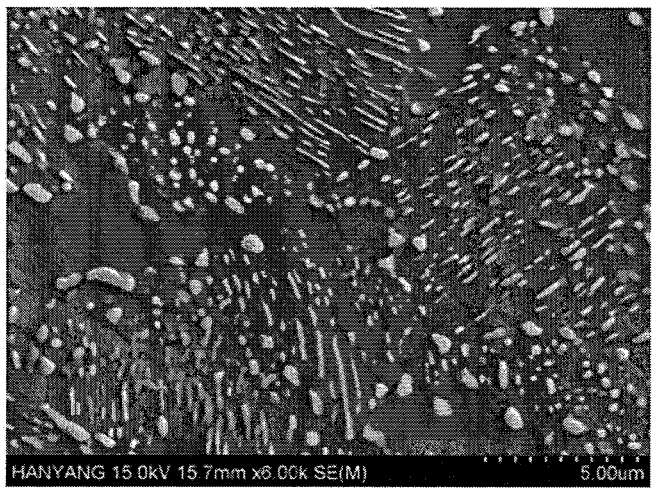
FIG. 8

DIES FOR SHEAR DRAWING

TECHNICAL FIELD

The present invention relates to a die for shear drawing used for drawing a material such as a wire rod, a profile, or a rectangular bar, and more particularly, to a new die for shear drawing capable of performing ultra-fine grain refinement in a metal structure and improving mechanical properties by continuous drawing, and capable of performing continuous drawing and shear deformation simultaneously, which enables a decrease in a heat treatment temperature and a reduction of heat treatment time in carbon steels subjected to a spheroidizing heat treatment.

BACKGROUND ART

The present invention relates to the technical field pertaining to equal channel angular extrusion (ECAE, see References [1] and [2]), one of a range of severe plastic deformation technologies, and more specifically, to equal channel angular drawing (ECAD, see Reference [3]).

ECAE is a process imparting severe plasticity, due to shear deformation, to a metallic material by extruding the metallic material through a die in which two channels (inlet and outlet) having the same cross-sectional areas intersect with each other at an arbitrary angle. As a result, grain refinement and a reduction of spheroidizing time are achieved, and mechanical properties are improved (see Reference [4]). However, even though ECAE is a good severe plastic deformation technology, a continuous process is not possible because it is an extrusion process. Therefore, there is a limitation in the commercialization of ECAE.

Thereafter, ECAD capable of obtaining a material having similar characteristics to a material processed through ECAE and imparting severe plastic deformation as well as performing a continuous process was introduced. Although ECAD, as in the case of ECAE, uses an apparatus in which two channels having the same cross-sectional areas intersect to each other, ECAD is a method of drawing a workpiece instead of the extrusion thereof, as in ECAE. Therefore, ECAD was introduced as a processing technology capable of performing a continuous process, as well as imparting severe plastic deformation. However, since a material may not uniformly fill a die channel of the processing apparatus during a drawing process, i.e., a filling of a material is insufficient, there are limitations in that a cross section of the material is non-uniformly distributed in a length direction after the processing of the material, and necking is generated during the drawing of the material (see Reference [5]).

Although various apparatuses and methods capable of applying severe plastic deformation technology as well as performing a continuous process may be introduced in addition to the foregoing technology (see Reference [6]), materials having severe plastic deformation applied thereto are mainly sheets, and the apparatuses and methods do not suggest a concrete method for a material to be passed through an equal channel angle and to guarantee surface quality and cross-sectional uniformity of the sheets after processing.

REFERENCES

[1] United States patent registration No. 5400633.

[2] United States patent registration No. 5513512.

[3] U. Chakkingal, A. B. Suriadi, and P. F. Thomson, "Microstructure Development during Equal Channel Angular Drawing of Al at Room Temperature", Scripta Materialia, vol. 39, No. 6, 1998, pp. 677-684.

[4] Korean published patent No. 2002-0093403

[5] J. Alkorta, M. Rombouts, J. D. Messemaeker, L. Froyen, J. G. Sevillano, "On the Impossibility of Multi-Pass Equal Channel Angular Drawing", Scripta Materialia, vol. 47, 2002, pp. 13-18.

[6] Jong U Park and Cha Yong Im, "Technologies for Manufacturing High-Strength Nano-Bulk Materials by Processing", Met. Meter. Int., vol. 16, No. 5, 2003, pp. 10-29.

An aspect of the present invention provides a die for shear drawing capable of performing continuous drawing and shear deformation simultaneously.

SUMMARY OF THE INVENTION

According to an aspect of the present invention, there is provided a die for shear drawing including: a material processing channel in which a material is sheared and drawn while passing therethrough, wherein the processing channel includes an inlet path positioned at a front end thereof, and an outlet path positioned at a rear end thereof, when viewed from a movement direction of a material, the inlet path and the outlet path are connected to intersect central axes thereof at a certain angle, and the processing channel includes a cross-section reduction segment allowing an outlet cross-sectional area of the outlet path to be smaller than an inlet cross-sectional area of the inlet path to thereby draw out a material from an exit of the outlet path with the material filled therein.

According to the present invention, continuous shear deformation is possible and a filling of a material in a die is good during shear drawing such that an almost constant value of an aspect ratio in a cross section of a material may be obtained along an entire length of the material after shear drawing. As a result, ultra-fine grain refinement may be performed and mechanical properties may be improved. With respect to carbon steels subjected to spheroidizing heat treatment, effects enabling a reduction of a heat treatment temperature and a time used therefor may be obtained.

DESCRIPTION OF DRAWINGS

The above and other aspects, features and other advantages of the present invention will be more clearly understood from the following detailed description taken in conjunction with the accompanying drawings, in which:

FIGS. 1(*a*) and (*b*) are schematic views illustrating in FIG. 1(*a*) a typical drawing process and in FIG. 1(*b*) a shear drawing process of the present invention;

FIG. 2 is a cross-sectional view illustrating a cross section of a die for shear drawing according to the present invention;

FIG. 5 is photographs showing results of manufacturing dies for a) typical ECAD and (b) shear drawing of the present invention;

FIG. 8 is micrographs showing microstructures of spheroidized materials in the cases of (a) shear drawing according to the present invention and (b) typical drawing.

DETAILED DESCRIPTION OF THE INVENTION

Figure 3:
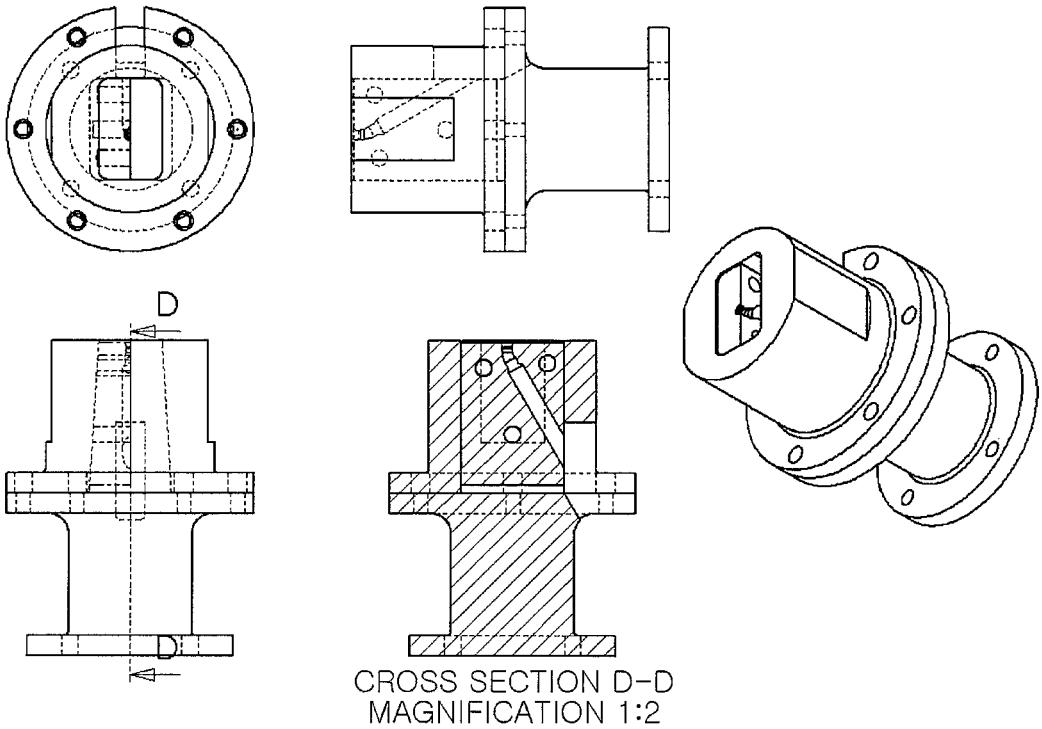
FIG. 3 is working drawings of a die for test evaluation according to the present invention.

Exemplary embodiments of the present invention will now be described in detail with reference to the accompanying drawings.

According to the present invention, a die for shear drawing, performing shear deformation and drawing simultaneously is proposed, based on a typical drawing process, in order to solve limitations in an application of a continuous process which has been considered as the biggest obstacle to typical severe plastic deformation technology.

As illustrated in FIG. 1(*b*), although a material is deformed by drawing while a cross section thereof is reduced as in a typical drawing die [see FIG. 1(*a*)], a major difference between the present invention and a typical drawing process is, in that there are processing channels, i.e., an inlet path and an outlet path, in a die similar to typical ECAE technology as characteristics of the present invention, and since the inlet path and the outlet path are combined to intersect central axes thereof at a certain angle, shear strain is exerted on a workpiece passing through the channels.

In the present invention, an angle between the central axes of the inlet path and the outlet path is defined as an intersecting angle, and the technology for performing drawing and shear deformation at the same time is defined as shear drawing technology.

The intersecting angle according to the present invention may be in a range of 120°-160°.

The intersecting angle may not be more than about 160° for improving mechanical properties of a material by means of shear drawing.

The smaller the intersecting angle is, the more the increase in the amount of shear strain is. Accordingly, grain refinement is improved, but the filling of a material in a processing channel is decreased such that a material having a uniform cross-sectional area is difficult to be obtained after processing. Therefore, a lower limit of the intersecting angle may be 120°.

The intersecting angle, for example, may be in a range of 125°-140°.

Also, the processing channel is composed of an inlet path positioned at the front and an outlet path positioned at the rear when viewed from a movement direction of a material. To prevent the inferior filling of a material in the processing channel, a cross-section reduction segment has to be included, in which an outlet cross-sectional area of the outlet path is reduced in comparison to an inlet cross-sectional area of the inlet path in order for a material to be drawn out by at least filling an outlet portion of the outlet path. The cross-sectional area denotes a cross section perpendicular to a movement direction of a material, and a shape thereof may be varied to have a shape such as an oval or a polygon, in addition to a circle.

The processing channel may be formed to have a reduction ratio (RA)(where, $RA=((AI-AO)/AI)\times 100$) of 10-60% at an outlet of the outlet path of the processing channel reduced by means of the cross-section reduction segment. AO represents an outlet cross-sectional area and AI represents an inlet cross-sectional area of the processing channel, respectively.

When the reduction ratio (RA) is 10% or more, it is effective in preventing necking of a material. The more the increase in the reduction ratio is, the better the filling of a material in the processing channel becomes, such that the material may have a uniform cross section. However, when the reduction ratio is more than 60%, there is a limitation in that the material may break during processing due to an increase in a tensile load.

Also, the cross-section reduction segment may include a first cross-section reduction segment formed at one side of the processing channel and a second cross-section reduction segment formed at the other side of the processing channel.

The first cross-section reduction segment and the second cross-section reduction segment may include an overlapping segment overlapped each other when viewed from a direction perpendicular to a movement direction of a material, and a cross-section reduction of the processing channel is obtained at both sides of the processing channel in the overlapping segment.

Further, any one of the first cross-section reduction segment and the second cross-section reduction segment may have one or more cross-section reduction segments.

Any one of the first cross-section reduction segment and the second cross-section reduction segment may have one or more cross-section reduction segments, and the other cross-section reduction segment may have a curved portion having a constant radius of curvature R.

Also, the one or more cross-section reduction segments are formed at any one or both of the inlet path and the outlet path, and the other curved cross-section reduction segment may be formed between the inlet path and the outlet path.

The one or more cross-section reduction segments may have a slope in which a channel cross-section of a rear portion is smaller than that of a front portion when viewed from the movement direction of a material.

An inclined angle of the cross-section reduction segment may be in a range of 5-15°.

Hereinafter, a die for shear drawing according to the present invention is described in detail with reference to the following drawings.

FIG. 2 illustrates a cross section of an example of a die for shear drawing according to the present invention.

Hereinafter, the die for shear drawing according to the present invention is described in detail with reference to FIG. 2. However, the die for shear drawing is not limited thereto.

When a size of a processing channel L can be represented as a diameter as illustrated in FIG. 2, an inlet cross section may be represented as an inlet diameter DI and an outlet cross section may be represented as an outlet diameter DO, respectively.

As illustrated in FIG. 2, a die 10 for shear drawing of the present invention includes a processing channel L, the processing channel L including an inlet path LI positioned at the front end thereof and an outlet path LO positioned at the rear end thereof when viewed from a movement direction of a material.

The inlet path LI and the outlet path LO are combined to form a certain intersecting angle CA between respective central axes.

The processing channel L of the die for shear drawing according to the present invention includes diameter reduction segments A and B, in which the outlet diameter DO of the outlet path LO is reduced in comparison to the inlet diameter DI of the inlet path LI in order for a material to be drawn out by at least filling an outlet portion of the outlet path.

The diameter reduction segments A and B may include a first diameter reduction segment A formed at one side of the processing channel L and a second diameter reduction segment B formed at the other side.

Although only one second diameter reduction segment B is illustrated in FIG. 2, the present invention is not limited thereto and two or more second diameter reduction segments B may be provided. Also, although the second diameter reduction segment B is formed only at the outlet path LO, the present invention is not limited thereto and the second diameter reduction segment B may be formed at any one or both of the inlet path LI and the outlet path LO.

The first diameter reduction segment A and the second diameter reduction segment B may include an overlapping segment A+B overlapped each other when viewed from a direction perpendicular to the movement direction of a material, and a diameter reduction of the processing channel L is obtained at both sides of the processing channel L in the overlapping segment A+B.

The second diameter reduction segment B may have a slope at a certain angle AP in order that a channel diameter of a rear portion is smaller than that of a front portion when viewed from the movement direction of a material.

An inclined angle AP of the diameter reduction segment may be in a range of 5-15°.

The first diameter reduction segment A has a curved portion having a constant radius of curvature R between the inlet path and the outlet path.

The undescribed symbol RI in FIG. 2 is a length of the inlet path where a curved portion starts, and RO represents an outlet path length of the curved portion.

Also, BL represents a bearing length connected to the outlet path of the present invention, wherein the bearing represents a segment determining the final diameter of a material after shear drawing deformation and is for improving dimensional accuracy.

Materials applied to the present invention may be nonferrous metals such as Al, Mg, or Cu in addition to carbon steels that require spheroidizing heat treatment. When a shear drawing method of the present invention is applied, mechanical properties may be improved by increasing effective strain by up to two times in comparison to a typical drawing process.

While the present invention has been shown and described in connection with the exemplary embodiments, it will be apparent to those skilled in the art that modifications and variations can be made without departing from the spirit and scope of the invention as defined by the appended claims.

MODE FOR INVENTION

Hereinafter, Examples of the present invention is described in detail. However, the present invention is not limited to the following Examples.

Example 1

A shape of a die for shear drawing according to the present invention and a shape of an ECAD die having the same channel diameter as the die for shear drawing were prepared. In order to compare degrees of filling of a material between two dies, experiments were carried out by using a finite element analysis program and fabricating the dies.

FIG. 3 illustrates a die mold and a fastening device for fabricating the die for shear drawing according to the present invention. A material used for a finite element analysis simulation and experiments of fabricating a real device was plain low carbon steel (0.1 wt % of C), and has an initial diameter of about 10 mm and a length of about 500 mm.

Finite element analyses were performed on the typical ECAD die having the same channel diameter and the die for shear drawing of the present invention in FIG. 3. Results of comparing the fillings of a material were presented in FIG. 4.

Figure 4:
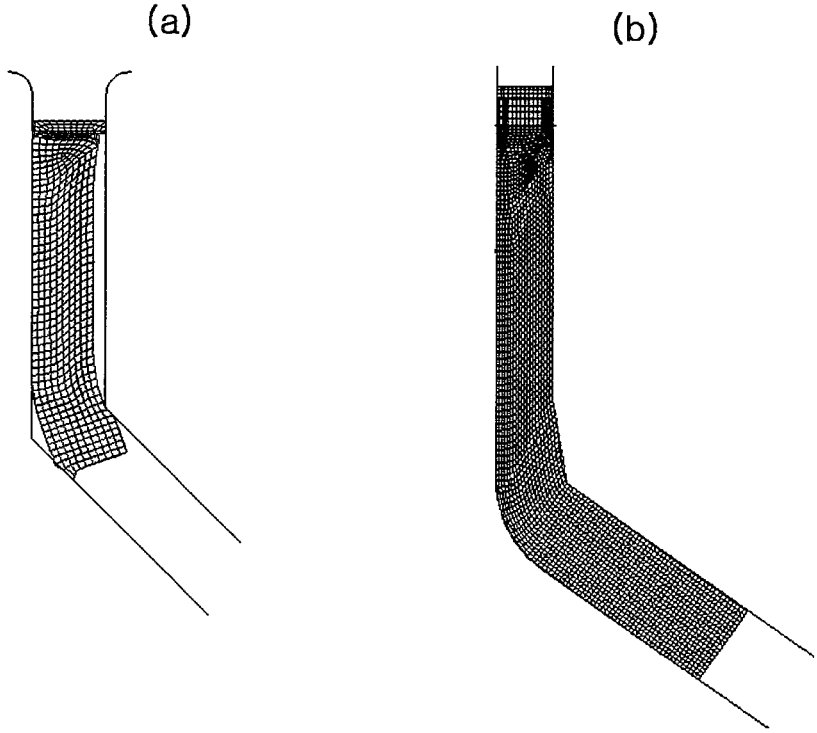
FIG. 4 shows simulation results using a finite element analysis program of (a) typical ECAD and (b) shear drawing of the present invention.

In FIG. 4, (a) represents a finite element analysis result from the ECAD die and (b) represents a finite element analysis result from the die for shear drawing of the present invention.

As illustrated in FIG. 4(*a*), a material drawn using the ECAD die exhibits a phenomenon in which the material is drawn by not completely filling the channel.

On the other hand, as illustrated in FIG. 4(*b*), when the die for shear drawing according to the present invention was used to apply a diameter reduction ratio of 60%, an intersecting angle of 125°, and an entrance angle of 10°, it may be understood that the filling of a material may be improved.

Also, FIG. 5 shows results of drawing using the material by employing the fabricated real die.

As shown in FIG. 5, the die for shear drawing (b) of the present invention exhibits better filling of a material than the typical ECAD die (a).

It may be understood that the filling of a material is improved according to an application of design factors of the present invention, and optimum design factor values appropriate for working conditions and workpieces may be also applied.

Example 2

Experiments for the optimization of design factor values were performed in order to design a die having the best filling of a material as in the foregoing Example 1.

Design factors in the present Example are defined based on the drawing shown in FIG. 2, and presented below—LI: inlet path length, LO: outlet path length, R: radius of curvature at a curved portion, RI: inlet path length where R is introduced, RO: outlet path length where R ends, AP: entrance angle, BL: bearing length, CA: intersecting angle, DI: inlet diameter, DO: outlet diameter.

A finite element analysis program was used as in Example 1 to obtain conditions for the design factors having the maximum effective strain, and simulation conditions are as follows. A material diameter at an inlet of 10.0 mm, a material diameter at an outlet of 8.5 mm (a reduction ratio of 28%), an intersecting angle of 135°, a drawing speed of 100 mm/min, and a friction coefficient of 0.13 were used, and a test material used was medium carbon steel (0.45 wt % of C).

First, flow stress diagrams were analyzed by performing compression tests, and then, final finite element analyses were performed after obtaining effective stresses under a large strain of 1.1 or more of effective stain.

Design factor values in certain ranges as in Table 1 were applied.

After processing according to each design factor value through the finite element analyses, an average long/short-axis diameter of a final cross section of a material, i.e., a filling of a material was obtained.

Figure 6:
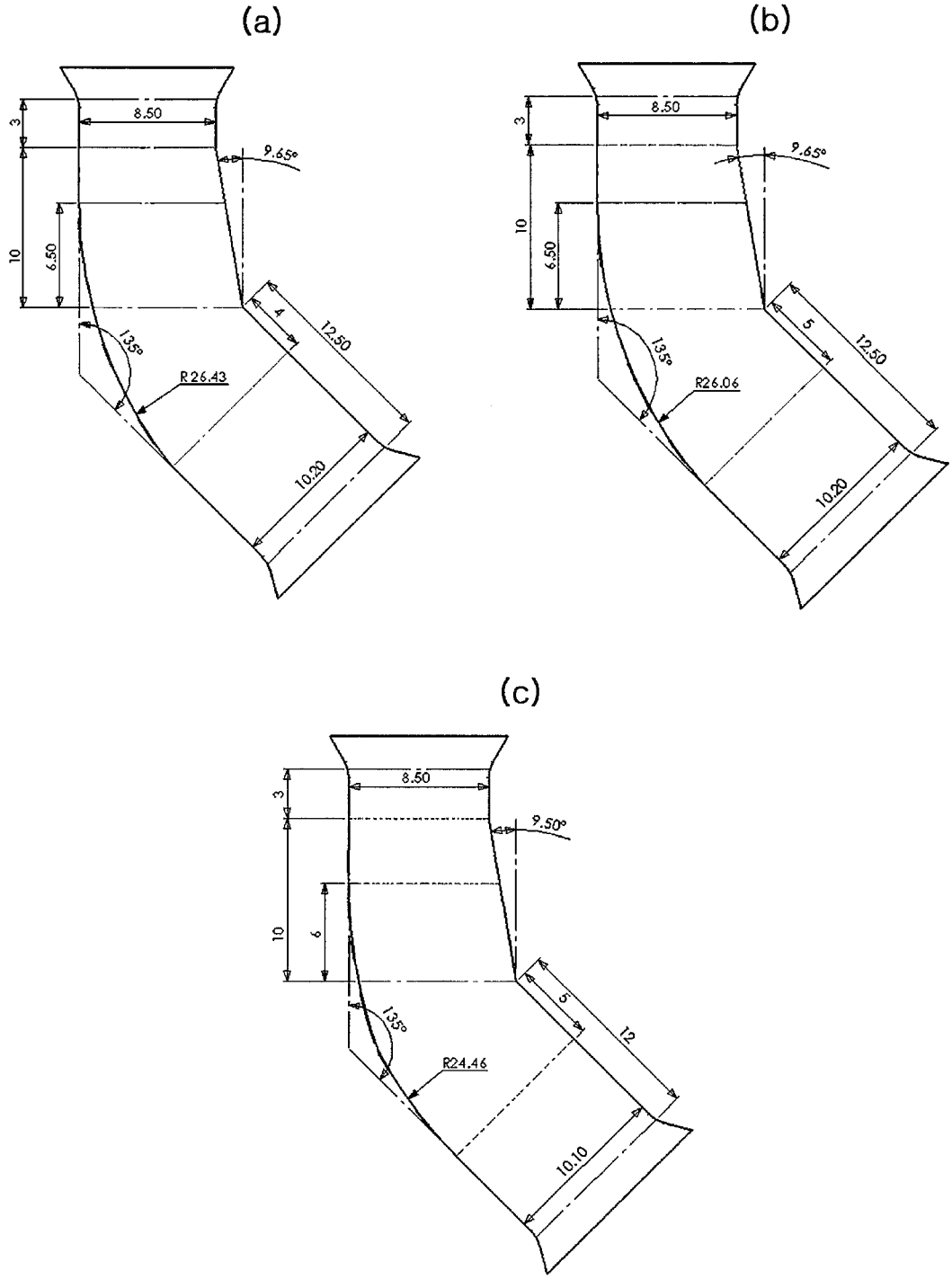
FIG. 6 is drawings illustrating design conditions of dies for shear drawing in Experimental Examples 2, 5 and 19.

In order to obtain design factor values exhibiting the maximum filling of a material, Experimental Examples of 2, 5 and 19, in which final diameters of materials calculated by each condition were close to an outlet path diameter of 8.5 mm, were selected. Drawings of dies for shear drawing designed according to the three selected conditions were presented in FIG. 6.

TABLE 1

| | Design Factors | | | | | | Material diameter after | Re- |
|---|---|---|---|---|---|---|---|---|
| Category | RI | AP | R | LO | RO | BL | working | marks |
| Experimental Example 1 | 3.0 | 9.65 | 27.09 | 10.0 | 6.5 | 3.0 | 8.16 | |
| Experimental Example 2 | 4.0 | 9.65 | 26.43 | 10.0 | 6.5 | 3.0 | 8.42 | select-ed |
| Experimental Example 3 | 5.0 | 8.00 | 27.10 | 10.0 | 6.5 | 3.0 | 8.29 | |
| Experimental Example 4 | 5.0 | 9.00 | 26.46 | 10.0 | 6.5 | 3.0 | 8.39 | |
| Experimental Example 5 | 5.0 | 9.65 | 26.06 | 10.0 | 6.5 | 3.0 | 8.42 | select-ed |

TABLE 1-continued

| Category | Design Factors RI | AP | R | LO | RO | BL | Material diameter after working | Remarks |
|---|---|---|---|---|---|---|---|---|
| Experimental Example 6 | 6.0 | 9.65 | 25.91 | 10.0 | 6.5 | 3.0 | 8.41 | |
| Experimental Example 7 | 7.5 | 9.65 | 25.95 | 10.0 | 6.5 | 3.0 | 8.40 | |
| Experimental Example 8 | 7.5 | 9.65 | 27.00 | 10.0 | 6.5 | 3.0 | 8.40 | |
| Experimental Example 9 | 7.5 | 9.65 | 30.00 | 10.0 | 6.5 | 3.0 | 8.19 | |
| Experimental Example 10 | 7.5 | 9.65 | 30.00 | 10.0 | 6.5 | 5.0 | 8.17 | |
| Experimental Example 11 | 7.5 | 9.65 | 30.00 | 10.0 | 6.5 | 7.0 | 8.16 | |
| Experimental Example 12 | 5.0 | 9.50 | 31.00 | 8.0 | 8.0 | 3.0 | 7.93 | |
| Experimental Example 13 | 5.0 | 9.50 | 22.41 | 9.0 | 5.0 | 3.0 | 8.36 | |
| Experimental Example 14 | 5.0 | 9.50 | 24.93 | 9.0 | 6.0 | 3.0 | 8.30 | |
| Experimental Example 15 | 5.0 | 9.50 | 27.61 | 9.0 | 7.0 | 3.0 | 8.15 | |
| Experimental Example 16 | 5.0 | 9.50 | 30.45 | 9.0 | 8.0 | 3.0 | 8.03 | |
| Experimental Example 17 | 5.0 | 9.50 | 33.45 | 9.0 | 9.0 | 3.0 | 7.97 | |
| Experimental Example 18 | 5.0 | 9.50 | 22.00 | 10.0 | 5.0 | 3.0 | 8.40 | |
| Experimental Example 19 | 5.0 | 9.50 | 24.46 | 10.0 | 6.0 | 3.0 | 8.43 | selected |
| Experimental Example 20 | 5.0 | 9.50 | 27.08 | 10.0 | 7.0 | 3.0 | 8.37 | |
| Experimental Example 21 | 5.0 | 9.50 | 29.84 | 10.0 | 8.0 | 3.0 | 8.17 | |
| Experimental Example 22 | 5.0 | 9.50 | 32.76 | 10.0 | 9.0 | 3.0 | 8.00 | |
| Experimental Example 23 | 5.0 | 9.50 | 35.84 | 10.0 | 10.0 | 3.0 | 7.93 | |

Figure 7:
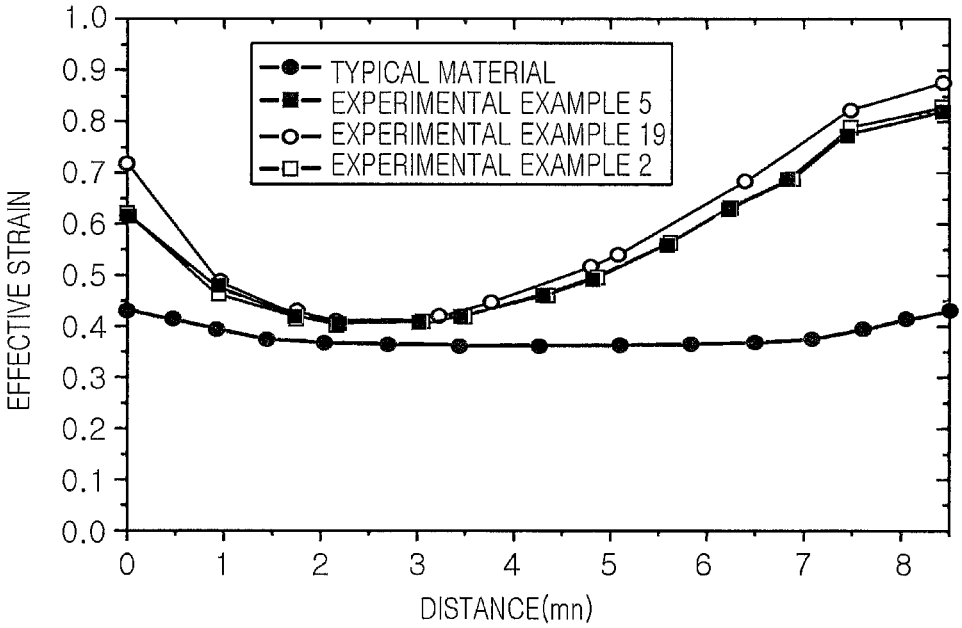
FIG. 7 is a graph showing cross-sectional effective strains in the case of typical drawing and in Experimental Examples 2, 5, and 19.

FIG. 7 is a graph showing effective strains according to positions along a cross-sectional diameter of a material after processing using the three selected dies, together with effective strain of a material subjected to a typical drawing process.

Herein, it may be understood that a material subjected to shear drawing has an effective strain of 1.2-2.2 times greater than a typical material subjected to the same reduction ratio.

Particularly, it may be understood that a condition in Experimental Example 19 among the three selected conditions exhibits an excellent effective strain as well as the filling of a material.

As shown in the Example 2, it is important to apply optimum design factor values according to an intersecting angle and a reduction ratio. Final mechanical properties of a material are improved according to an improvement in the filling of a material, and particularly, grain refinement and spheroidization may be promoted by an increase in effective strain.

Example 3

An optimized die was fabricated in Example 2, and various materials were deformed by shear drawing. Drawing conditions were the same as those of Example 2, and medium carbon steel (0.45 wt % of C), subjected to a spheroidizing heat treatment, was used as a workpiece.

The spheroidizing heat treatment is a process applied to a material mainly subjected to a cold forging process, and is a heat treatment process facilitating cold forging by a softening of a material. That is, the spheroidizing heat treatment is a process of transforming lamellar cementites having a hard microstructure into spherical shapes.

Although heat treatment conditions differ according to steel types or heat treatment facilities, a material during typical spheroidizing heat treatment is heated above an $A_1$ temperature point and maintained just below the $A_1$ temperature point for a certain period of time, and then, is stepwise cooled in a furnace. A total process may require a lengthy period of time, i.e., about 20-40 hours.

A portion of cementites having a lamellar structure is finely segmented due to the diffusion of carbon during heat treatment and a portion is redissolved in a matrix. Thus, spheroidization of the finely segmented cementites occurs at the same time.

Therefore, when the lamellar cementites are deformed by processing, spheroidization is promoted because end portions of the cementites are energetically unstable in comparison to the surroundings. This is similar to a phenomenon in which spheroidization is promoted in a material subjected to a drawing process.

FIG. 8 is micrographs comparing microstructures obtained by heat treating at 700° C. for 1 hour after performing (a) shear drawing according to the present invention and (b) typical drawing at the same reduction ratio by using the foregoing material.

It may be understood that spheroidization is better performed for the material subjected to shear drawing according to the present invention, and as a result, spheroidizing heat treatment time may be greatly reduced. Even considering sizes between a furnace in a laboratory and a furnace for a real process, spheroidizing heat treatment time in the real process may be reduced by half or more.

Therefore, the shear drawing process of the present invention may provide a promoting effect on spheroidization when the same reduction ratio is applied by substituting a die used in a typical drawing process. Also, it is considered that when shear drawing is applied to non-ferrous metals such as Al, Mg, or Cu, effective strain may be increased to be about two times as that of a typical drawing process based on the results of the Example 2 so that mechanical properties may be improved.

The invention claimed is:

1. A die for shear drawing comprising a material processing channel in which a material is sheared and drawn while continuously passing therethrough, wherein the processing channel includes an inlet path positioned at a front end thereof, and an outlet path positioned at a rear end thereof, when viewed from a movement direction of a material, the inlet path and the outlet path are connected to intersect central axes thereof at a certain angle, and the processing channel includes a cross-section reduction segment allowing an outlet cross-sectional area of the outlet path to be smaller than an inlet cross-sectional area of the inlet path to thereby draw out a material from an exit of the outlet path with the material filled therein, wherein the cross-section reduction segment comprises a first cross-section reduction segment formed at one side of the processing channel and a second cross-section reduction segment formed at the other side of the processing channel, wherein any one of the first cross-section reduction segment and the second cross-section reduction segment has one or more cross-section reduction segments, and the other cross-section reduction segment has a curved portion, and wherein the one or more cross-section reduction segments have a slope allowing a channel cross-section of a rear portion to be smaller than that of a front portion when viewed from the movement direction of a material.

2. The die for shear drawing of claim 1, wherein an intersecting angle formed between the central axes of the inlet path and the outlet path is in a range of 120° to 160°.

3. The die for shear drawing of claim 2, wherein a reduction ratio (RA) [((AI−AO)/AI)×100] at an outlet of the outlet path of the processing channel reduced by means of the cross-section reduction segment is in a range of 10% to 60%.

4. The die for shear drawing of claim 1, wherein the first cross-section reduction segment and the second cross-section reduction segment comprise an overlapping segment overlapped each other when viewed from a direction perpendicular to the movement direction of a material, and a cross-section reduction of the processing channel is obtained at both sides of the processing channel in the overlapping segment.

5. The die for shear drawing of claim 1, wherein any one of the first cross-section reduction segment and the second cross-section reduction segment has one or more cross-section reduction segments.

6. The die for shear drawing of claim 1, wherein the cross-section reduction segment has a curved portion.

7. The die for shear drawing of claim 1, wherein the one or more cross-section reduction segments are formed at either or both sides of the inlet path and the outlet path, and the other curved cross-section reduction segment is formed between the inlet path and the outlet path.

8. The die for shear drawing of claim 1, wherein a slope angle of the one or more cross-section reduction segments is in a range of 5° to 15°.

* * * * *